US005097923A

United States Patent [19]

Ziegler et al.

[11] Patent Number: 5,097,923

[45] Date of Patent: Mar. 24, 1992

[54] ACTIVE SOUND ATTENATION SYSTEM FOR ENGINE EXHAUST SYSTEMS AND THE LIKE

[75] Inventors: Eldon W. Ziegler, Columbia; John W. Gardner, Silver Springs, both of Md.

[73] Assignee: Noise Cancellation Technologies, Inc., Columbia, Md.

[21] Appl. No.: 435,499

[22] Filed: Nov. 7, 1989

Related U.S. Application Data

[63] Continuation-in-part of Ser. No. 158,883, Feb. 19, 1988, abandoned.

[51] Int. Cl.[5] ..... F01N 1/06

[52] U.S. Cl. ..... 181/206; 381/71

[58] Field of Search ..... 181/206, 207, 227, 250, 181/269; 381/71

[56] References Cited

U.S. PATENT DOCUMENTS

| | | | |
|---|---|---|---|
| 3,712,412 | 1/1973 | Hassett et al. | 181/206 |
| 3,826,870 | 7/1974 | Wurm et al. | 181/206 X |
| 4,122,303 | 10/1978 | Chaplin et al. | 381/71 |
| 4,177,874 | 12/1979 | Angelini et al. | 181/206 |
| 4,489,441 | 12/1984 | Chaplin | 381/71 |
| 4,527,282 | 7/1985 | Chaplin et al. | 381/71 |

FOREIGN PATENT DOCUMENTS

| | | | |
|---|---|---|---|
| 1190317 | 3/1959 | France | 181/206 |
| 0214613 | 12/1983 | Japan | 181/206 |
| 60-22010 | 2/1985 | Japan . | |
| 62-48911 | 7/1987 | Japan . | |
| 0836652 | 6/1981 | U.S.S.R. | 181/206 |

OTHER PUBLICATIONS

"Electronics Cancel Noise and Vibration at Source", Motorship, vol. 68, No. 806, Sep. 1987, London GB, p. 47.

*Primary Examiner*—Brian W. Brown

[57] ABSTRACT

An active sound attenation system for combustion engine exhaust systems and the like is disclosed. To protect the counter-noise acoustic wave generator from the environment of the medium propagating the undesirable noise, an acoustically tuned anti-noise chamber is interposed between the wave generators 19, 19A and the location of the medium with the undesirable noise. To provide for global cancellation at the outlet end 4, of the exhaust pipe 10, the anti-noise chamber 11, 11A has an annular opening disposed substantially in the plane 4 of the exhaust pipe outlet thereby giving the undesirable noise and the cancelling noise an apparent common source.

33 Claims, 5 Drawing Sheets

ACTIVE SOUND ATTENATION SYSTEM FOR ENGINE EXHAUST SYSTEMS AND THE LIKE

BACKGROUND AND SUMMARY OF THE INVENTION

This is a Continuation-in-Part Application of U.S. patent application Ser. No. 07/158,883, filed Feb. 19, 1988.

The present invention is related to an improved arrangement for reducing intake and/or exhaust noises from combustion engines and the like. More specifically, the present invention relates to a new sound attenuation arrangement for such apparatus which uses anti-noise, or counter-noise, acoustic wave generators to attenuate the sound generated in such apparatus. Various aspects of the present invention can be utilized in attenuating sound in combustion engine intake and exhaust systems, in compressors, and in pumps and the like. The preferred embodiment of the invention described concerns primarily to combustion engines, however, it is to be understood that the invention is adaptable to attenuate sound in other arrangements exhibiting similar noise generating configurations such as in the intake and exhaust of certain compressor and pumps and the like.

Numerous passive systems for suppressing noise at the intake and/or exhaust of gas movement systems have been proposed previously. Such passive systems use sound insulating material and/or baffles to suppress sound waves before they reach the surrounding atmosphere. These so-called "passive systems", such as conventional automotive exhaust gas mufflers, inherently restrict the exhaust gas- flow, thereby resulting in energy losses with resultant reductions in the efficiency of operation of the vehicle combustion engines. It is well known to those skilled in the art of internal combustion engines that reduction or removal of the exhaust gas restriction back pressure substantially improves the performance of the engine. However, permitting such "straight pipe" operation of automotive vehicles results in sound patterns in public places that are unpleasant as well as unhealthy. For these reasons, virtually every industrialized nation has restrictions on the level of noise propagation that can be generated by automotive vehicles and other machinery operating in public places. To date, in order to satisfy these noise abatement restrictions, virtually all automotive vehicles have relied on passive muffler systems, and consequently reduction in engine efficiency. Coupled with this reduction in engine efficiency is of course inherent increased pollution due to increased hydrocarbon fuel consumption.

So-called "active" noise-cancellation systems have been proposed in the past and adapted to certain environments on a small scale, usually environments involving the relatively constant frequency sound generation pattern of the type that might be experienced in a fixed combustion engine of constant operational velocity for use in a generator station or the like. U.S. Pat. Nos. 4,122,303; 4,489,441; and 4,527,282 to Chaplin et al. disclose various aspects of active noise cancellation systems. French Patent 1,190,317 to Sherrer; U.S. Pat. Nos. 4,677,676 and 4,677,677 to Eriksson, and U.S. Pat. No. 4,473,906 to Wannaka disclose additional methods for active noise cancellation in building system air ducts or exhaust pipes in which the cancelling noise generator (speaker) is required to be directly exposed in the exhaust gas stream. Those systems requiring placement of the speakers in the exhaust gas stream, which generates the undesirable sound which is to be cancelled, implement the speakers in such a harsh chemical and heat environment that they cannot operate over an extended period of time, at least not without inordinate costs for insulating the speaker and/or designing them to withstand the loud environment. Further, such placement restricts the flow of exhaust gases to some extent, thereby resulting in the above-mentioned disadvantages regarding back pressure on the combustion engine. Furthermore, the prior art systems that have been utilized in exhaust environments do not exhibit the compactness to facilitate commercialization and use on automotive and marine passenger vehicles and also do not have control systems that are responsive to the varying noise spectrum generated during normal driving of such vehicles, with acceleration and deceleration over a wide range of vehicle engine speeds.

SUMMARY OF THE INVENTION

An object of the present invention is to provide an improved active noise cancellation system that is compatible with the operating conditions of motor vehicle combustion engine exhaust systems and the like. Another object of the invention is to provide a system that will suppress noise generated from rapidly changing noise sources such as experienced in motor vehicle exhaust systems during normal driving operations and the like. Another object of the invention is to provide a compact, economically manufactured sound cancellation system that can be incorporated into mass production vehicles with a consequent substantial reduction in the overall costs of operating such vehicles as compared with vehicles having conventional passive muffler systems.

These and other objects are achieved according to an embodiment of the invention by providing a sound attenuation system which exhibits one or more of the following characteristics:

(i) an anti-noise chamber is interposed between the anti-noise acoustic wave generators and the fluid guide system for the fluid medium propagating the undesirable noise, thereby Protecting the anti-noise acoustic wave generators from any harsh environment of the undesirable noise propagating medium;

(ii) the anti-noise acoustic wave generators open into an acoustically tuned anti-noise chamber which in turn opens to the fluid medium propagating the undesirable noise thereby enhancing the effective efficiency of the anti-noise acoustic wave generator; and (iii) the anti-noise acoustic waves are introduced into the medium propagating the undesirable sound at a position so that the effective source of both the undesirable sound and the anti-noise sound is substantially nearly coincidental, thereby enhancing efficient global cancellation of the undesirable sound.

In certain preferred embodiments of the present invention, an active noise attenuation system is so constructed as to avoid the placement of the anti-noise acoustic wave generators into the environment of fluid flow propagation of the undesirable noise, such as the harsh environment of the exhaust gases of a vehicle exhaust system. In especially preferred embodiments, the attenuation system includes an anti-noise chamber which surrounds over a portion of the length of, a centrally disposed engine exhaust pipe, the anti-noise chamber and exhaust pipe opening to atmosphere in substantially the same plane, and at least within a length corresponding to less than one third of the shortest wave length of the undesirable noise to be attenuated. The anti-noise speakers open into the anti-noise chamber, which is totally isolated from the exhaust pipe and thereby the speakers are not subjected to the harsh chemical and heat environment of the exhaust gases.

In certain especially preferred embodiments for use with automotive exhaust systems, the anti-noise chamber is constructed as an acoustically tuned annular chamber concentric with the exhaust pipe. In especially preferred embodiments, the anti-noise speakers are symmetrically arranged around the axis of the exhaust pipe and anti-noise chamber. The anti-noise chamber is constructed as a first, relatively large diameter section which is closed off at one end by an annular supporting plate that is connected to the exhaust pipe, the speakers being mounted adjacent that end plate. The anti-noise chamber then extends in the downstream direction of the exhaust pipe and opens at the same plane as the atmospheric outlet of the exhaust pipe, thereby Providing an effective coincidental sound source for both the anti-noise sound waves and the undesirable sound waves from the exhaust pipe, with consequent "global" noise cancellation.

According to certain preferred embodiments of the invention, the anti-noise acoustic wave generators are controlled by a digital controller which has inputs from a synchronization sensor monitoring the engine rotational speed and a residual sensor microphone which picks up the sound at the outlet of the exhaust pipe. These sync, sensor and microphone signals are processed by the controller and drive power amplifiers for the anti-noise speakers.

According to other preferred embodiments of the control system for the anti-noise acoustic wave generators, an upstream sensor microphone picks up the sound in the exhaust pipe upstream of the location of the anti-noise chamber and feeds its signal to the digital controller, the other signal to the controller being from a residual sensor microphone located at the outlet end of the exhaust pipe. As in the other embodiments referred to in the immediately preceeding paragraph, the digital controller processes this sensed information and accordingly controls and drives the anti-noise acoustic wave generators to cancel the sound.

Although the preferred embodiments described involve vehicle combustion engine exhaust systems, preferred embodiments of the invention are also contemplated for engine intake systems, for compressors and pumps with undesirable sound waves propagated in a pipe exhausting to atmosphere, and the like.

Further scope of applicability as well as additional objects, advantages and novel features of the present invention will become apparent from the following detailed description of the invention when considered in conjunction with the accompanying drawings. However, it should be noted that the detailed description and specific examples, while indicating preferred embodiments of the present invention, are given by way of illustration only, since various changes and modifications within the spirit and scope of the invention will become apparent to those skilled in the art.

DETAILED DESCRIPTION OF THE DRAWINGS

Figure 1:
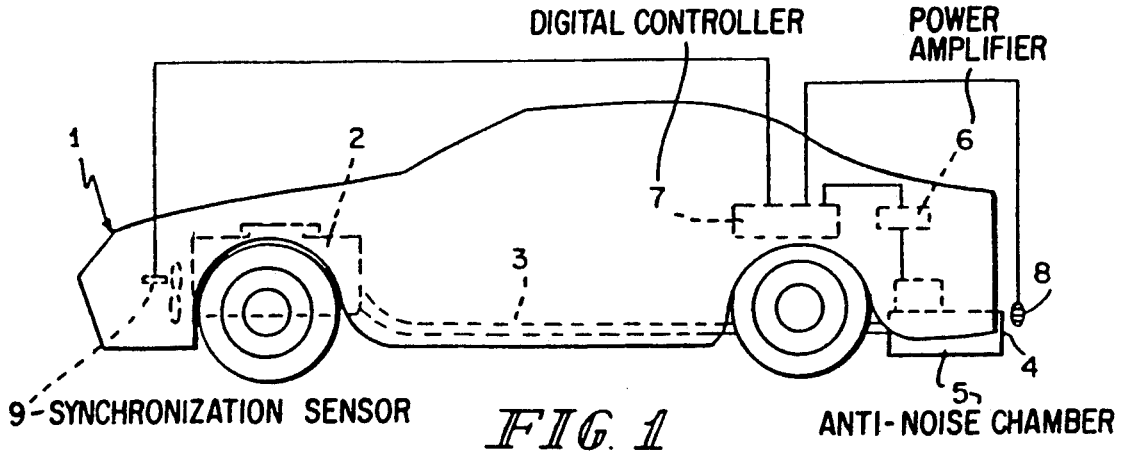
FIG. 1 is a schematic side view of a passenger vehicle depicting the location of the engine exhaust system and a digital muffler system constructed according to a preferred embodiment of the present invention.
Figure 2:
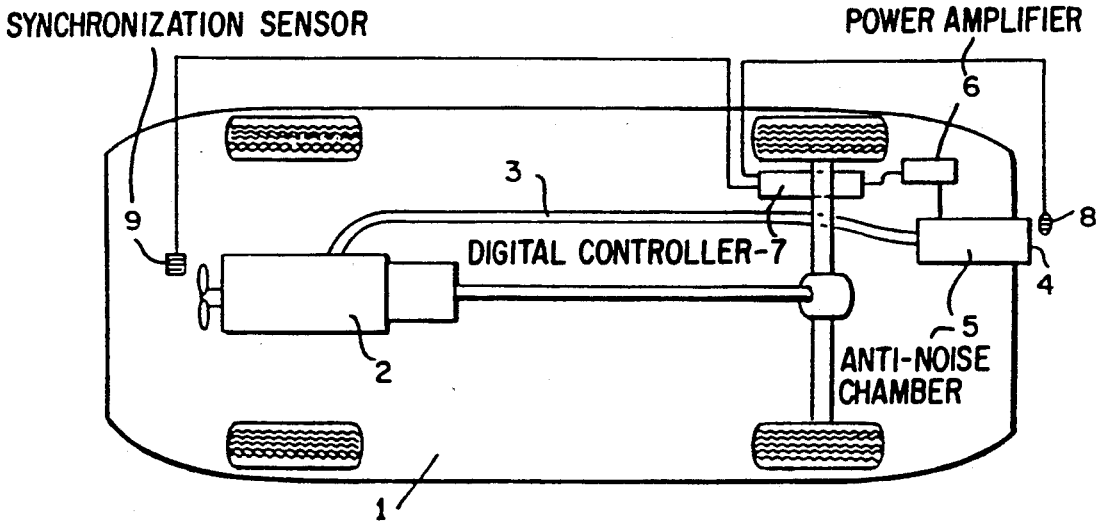
FIG. 2 is a schematic bottom view of the vehicle of FIG. 1 depicting the vehicle exhaust system and active digital muffler system constructed according to a preferred embodiment of the present invention.

FIGS. 1 and 2 schematically depict respective side views and bottom views of a passenger motor vehicle having an active digital muffler system constructed according to preferred embodiments of the present invention. The system depicted in FIGS. 1 and 2 corresponds to the FIG. 10 embodiment of the overall system (described in more detail below). The passenger vehicle 1 includes a multi-cylinder/piston internal combustion engine 2, the exhaust of which is transported by exhaust pipe system 3 to the exhaust outlet 4 at the rear of the vehicle. The rear portion of the exhaust pipe system 3, which is depicted as a single exhaust pipe in the following description, although similar duplicate arrangements can be provided for dual exhaust pipe systems, is provided at its rear end with a surrounding anti-noise chamber arrangement 5, which includes anti-noise speakers driven by a power amplifier 6 and digital controller 7. The digital controller 7 receives input signals from a residual sensing microphone 8 adjacent the exhaust outlet 4 and a synchronization sensor 9, such as a tachometer, implemented at the drive shaft of the engine 2.

Figure 3:
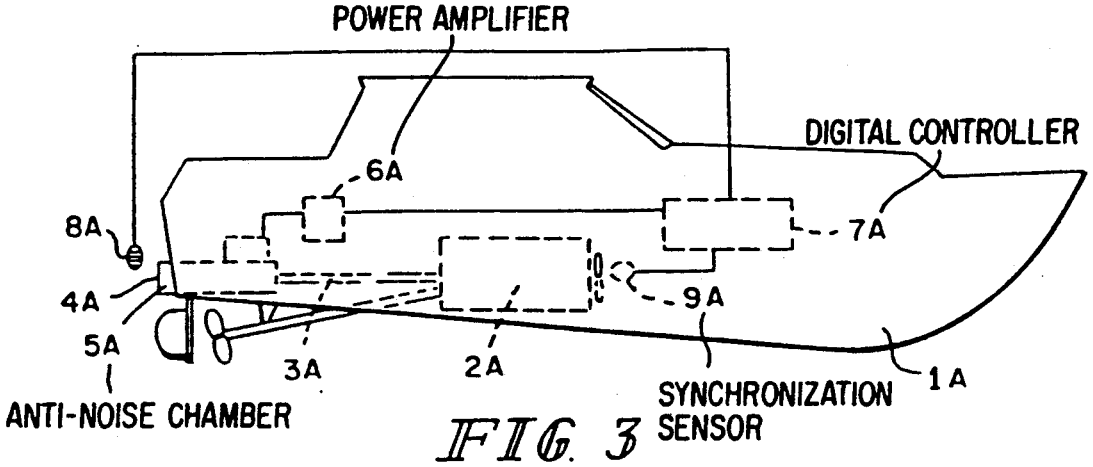
FIG. 3, is a side schematic view of a motor boat equipped with another preferred embodiment of the present invention.
Figure 4:
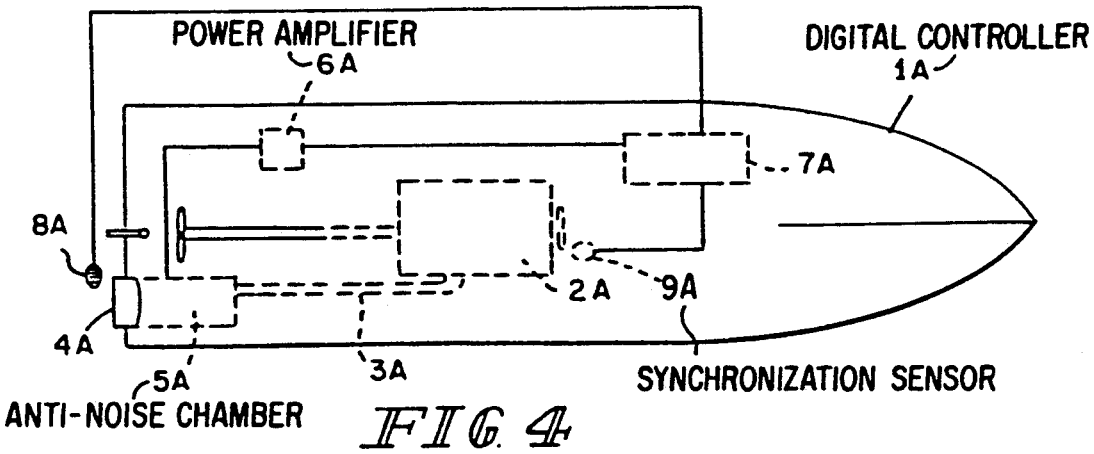
FIG. 4 is a schematic view showing the engine, exhaust system and active digital muffler system for use with the boat of FIG. 3.

FIGS. 3 and 4 schematically depict a preferred embodiment of an active digital muffler system according to the invention installed on a motor boat 1A, which, in a similar manner as the passenger motor vehicle of FIGS. 1 and 2, includes a reciprocating multi-cylinder/-piston internal combustion engine 2A, an exhaust pipe system 3A with an outlet 4A. An anti-noise chamber arrangement 5A is provided adjacent the downstream end of the exhaust pipe system 3 and includes speakers driven by a power amplifier 6A and controlled by a digital controller 7A. The digital controller 7A is in turn supplied with input signals from a residual sensor microphone 8A near the exhaust outlet of the boat motor and a synchronization sensor 9A of the output drive shaft of the boat motor engine 2. Certain other embodiments for use with boats will include water supplied exhaust system cooling arrangements, wherein water flow is directed into the exhaust pipe or wherein water flow in is directed into an annular jacket surrounding the exhaust, such cooling arrangements being well known in the motor boat industry.

The following description of the details of the anti-noise chamber arrangement surrounding the exhaust pipe, and the controller circuit for controlling the same, is similar for the embodiments for both the over the road passenger motor vehicles of FIGS. 1 and 2 and the motor boat of FIGS. 3 and 4. It will be understood by those skilled in the art that certain components in the motor boat environment need to be "marine" qualified to withstand salt sea air and the like.

Figure 5:
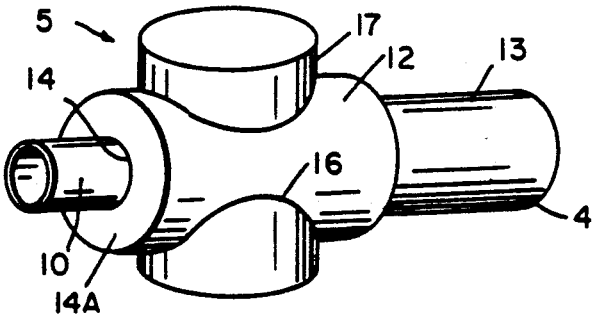
FIG. 5 is a schematic perspective view of an exhaust muffler arrangement constructed according to a preferred embodiment of the present invention.
Figure 6:
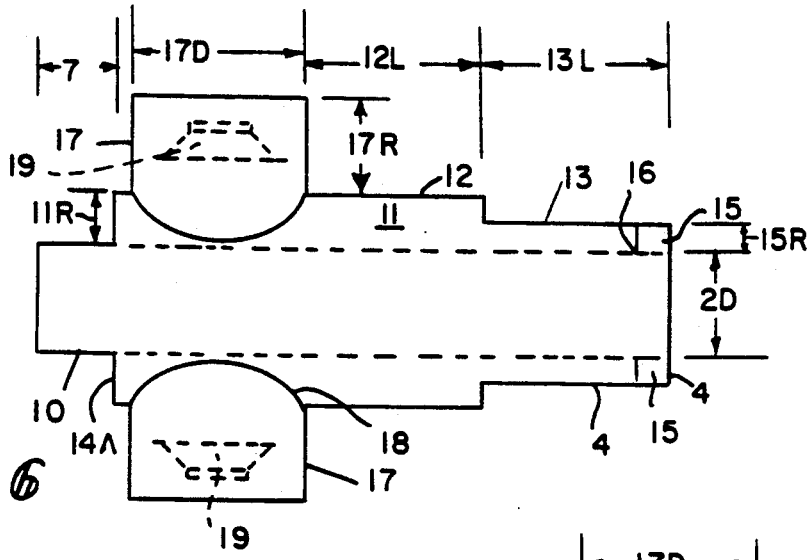
FIG. 6 is a longitudinal sectional view of the muffler arrangement of FIG. 5.
Figure 7:
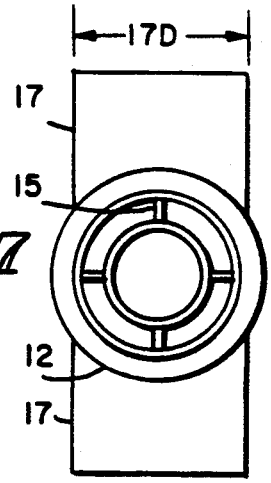
FIG. 7 is an end view taken from the right side of FIG. 6.

FIGS. 5–7 schematically depict a first preferred embodiment of an anti-noise chamber arrangement 5 and exhaust pipe. Chamber 5 of FIGS. 6–7 is constructed as an intregal sheet metal structure and includes a centrally disposed cylindrical exhaust pipe 10 which is connected to the exhaust pipe system 3, 3A (compare FIGS. 1 to 4). The left hand end of the exhaust pipe section 10 is preferably configured so as to be insertable into an existing exhaust pipe of an engine exhaust system 3,3A, with an appropriate sealing clamping connection being provided.

An anti-noise chamber 11 is provided in annular surrounding relationship to the exhaust pipe 10. The anti-noise chamber 11 is defined by first cylindrical section 12 of a large diameter and an adjoining smaller diameter section 13. The left hand end of the large diameter section 12 is closed off by an annular end plate 14A which is supported at the outer surface of the exhaust pipe 10 by welding connection 14. The opposite end of the anti-noise chamber 11 is supported by radially extending support plates 15 attached by welding 16 at the exhaust pipe 2 and by welding 17 at the anti-noise chamber 13. A pair of cylindrical speaker support sections 17 are connected by a welding connection 18 to the cylindrical section 12 at a position adjacent the end cap 13. In the illustrated embodiment, the cylindrical speaker support sections 17 have a slightly smaller diameter than the diameter of the section 12 of the anti-noise chamber and are there joined by welding seams 18. These anti-noise speaker support cylinder sections 17 are disposed symmetrically with respect to the longitudinal axis of the exhaust pipe 10 and anti-noise chamber 11. Anti-noise speakers 19 are mounted in each of the respective support sections 17 and are disposed to generate sound waves emanating into the anti-noise chamber 11. The anti-noise chamber 11 is concentric and separate from the exhaust pipe 10, with the anti-noise sound waves generated by the speakers 19 propagated along the length of the member toward the opening and into the atmosphere at the same exit plane 4 as the exhaust gases from the exhaust pipe 10.

By arranging the speakers 19 to be symmetrical with the longitudinal axis of the exhaust pipe 10 and by providing the anti-noise chamber 11 as an annular chamber surrounding the pipe 10, the manufacture of the anti-noise muffler chamber arrangement is quite simple and it can be constructed as a unit that can be added on to an existing exhaust system 3 merely by connecting the left hand end of the pipe section 10 to the exhaust pipe of a vehicle. In especially preferred embodiments, the exhaust pipe 2 and the cylindrical sections 12, 13 making up the anti-noise chamber 11 and the speaker supports 17 are all constructed of metal that can be easily welded together, thus further simplifying the manufacturing operation. Embodiments are also contemplated which include a heat insulating connection at the exhaust pipe 10, such as an annular heat insulating material ring surrounding the pipe 10, which limits the transfer of heat to the components. Since the speakers 19 are disposed symmetrically with respect to the noise generating exhaust pipe 10, an especially efficient utilization of space and cancellation of noise is provided since there is symmetrical disposition of the anti-noise waves around the annular space at the outlet end 4 of the muffler pipe arrangement. Since the noise cancelling sound waves emanate in substantially the same plane of the exhaust gases, the anti-sound wave propagation is symmetrical with the sound wave propagation from the exhaust pipe outlet, thereby simplifying the construction and operation. The speakers 19 are also isolated by chamber 11 from the exhaust gases and thereby do not have to withstand the highly corrosive hot gases in the exhaust stream.

Other preferred embodiments are contemplated which utilize only a single speaker opening into the acoustically tuned chamber 11, the annular outlet at Plane 4 effectively providing an appropriate effective common point source for cancelling the undesired sound. The additional speakers of the preferred embodiments illustrated facilitate the use of smaller speakers for the same output, thus economizing space. Also embodiments are contemplated where the speakers are remote from the chamber 11, with the sound waves transmitted by duct work to open into chamber 11, such arrangements being practical where space considerations are important such as in passenger automobiles, and the like.

In an especially preferred practical embodiment, the dimensions are as follows referring to FIG. 6:

diameter 2D of the exhaust pipe 10 is 2.250 inches inside diameter, the length 7L between end plate 14A and the left end of the pipe 10 is 2 inches, the radial width 11R of the chamber section 12 outside of the pipe 10 is 1.75 inches, the radial width 13R between the outside of the pipe 10 and the outer wall of cylindrical section 13 is 0.75 inches, the radial length of the speaker support sections 17, 17R is 2.5 inches, the diameter of the cylindrical sections 17, 17D is 5 inches, the distance between the edge of the sections 17 and the end chamber section 12, 12L is 4.75 inches, and the length 13L of the section 13 is 5 inches.

Figure 8:
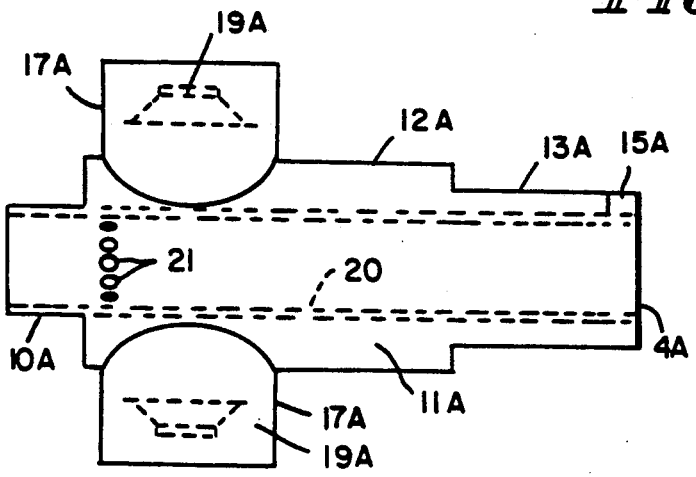
FIG. 8 is a view similar to FIG. 6, showing an alternative of the exhaust muffler arrangement of the present invention, having an intermediate exhaust gas low pressure cooling chamber.
Figure 9:
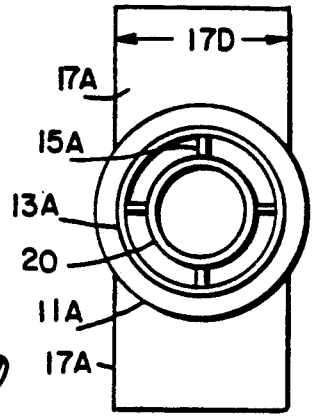
FIG. 9 is an end view from the right side of FIG. 8.

The embodiment of FIGS. 8 and 9 is the same as the embodiment of FIGS. 5 through 7 described above, except for the addition of an intermediate low pressure cooling exhaust gas chamber 20 between the anti-noise chamber 11A and the exhaust pipe. In FIGS. 8 and 9, like reference numerals with a suffix A will be included to designate corresponding structure from the embodiment of FIGS. 5 through 8. These structures are described only to the extent that they function differently from the corresponding structural embodiment of FIGS. 5 and 8. The annular intermediate chamber 20 is communicated with the exhaust pipe 10A by eight radially extending ⅛ inch diameter holes 21 in the pipe 10A. The holes 21 are disposed at the upstream end of the anti-noise chamber 11 and allow a small amount of cooling air to be sucked in by the exhaust gas flow through the opening at end plane 4A so cooling air flows in chamber 20 counter to the direction of flow of the exhaust gases and then into the exhaust pipe. The radially extending reinforcing plates 15 extend also through the end portion of this chamber 20 and support the respective concentric pipes forming same. The cooling air flow communicated to the exhaust pipe through openings 21 also aids in reducing the turbulence of the exhaust gases that exit from the exhaust pipe 10A to thereby further reduce noise overall levels.

Figure 10:
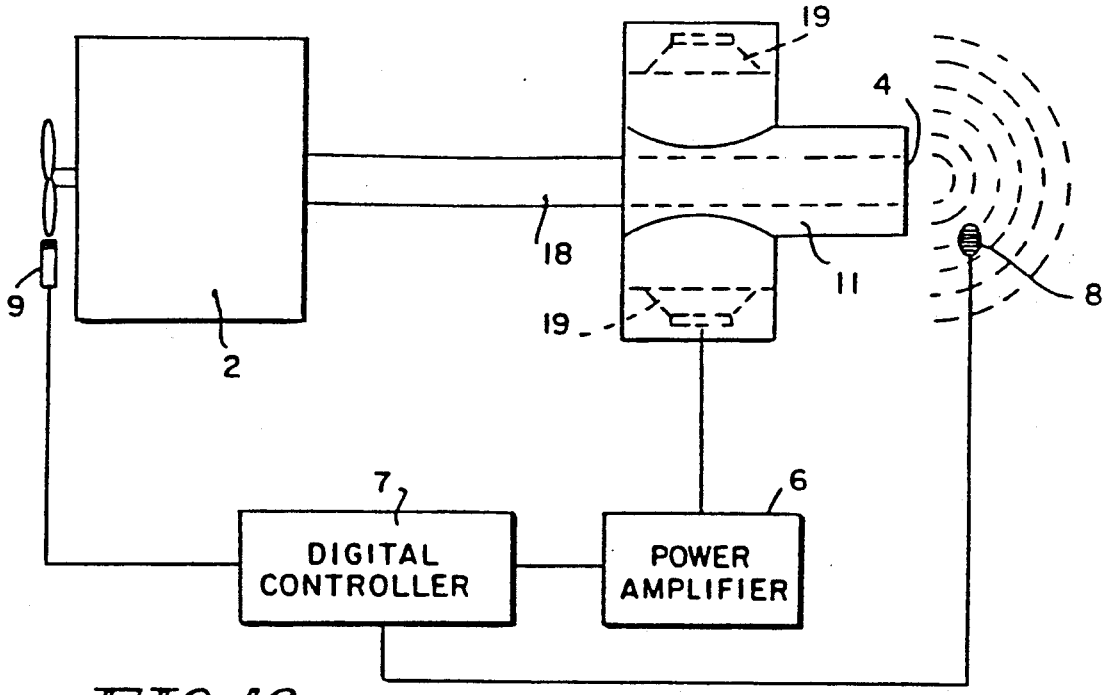
FIG. 10 is a schematic depiction of a complete active digital muffler system constructed according to a preferred embodiment of the present invention.

FIG. 10 schematically depicts a first embodiment of a control system for the active digital muffler system of the present invention. A synchronization sensor such as an engine tachometer 9 provides synchronization signal inputs to a digital controller 7, which is also supplied with signals from a residual sensor microphone 8 which picks up the actual sound wave pattern downstream of the outlet, 4 of the exhaust pipe 10 and the anti-noise chamber 11. The controller 7 controls power amplifier 6 which in turn drives the speakers 19 to generate the noise-cancelling waves in the chamber 11, which then travel to the outlet plane 4 of the exhaust pipe 10 and effect cancellation of the sound waves emanating from the pipe outlet. In especially preferred embodiments, the audio power amplifier 6 is integrated with the digital electronic controller 7. The digital controller can utilize a frequency domain alogorithm as described in U.S. Pat. No. 4,490,841 by Chaplin. Alternatively, the digital controller can utilize a time domain alogorithm as described in co-inventor Eldon Ziegler, Jr.'s pending U.S. patent application Ser. No. 238,188 filed on Aug. 30, 1988.

A practical speaker and microphone usable with a configuration as in FIGS. 5–7 or 8 and 9 has the following characteristics.

SPEAKER

MAGNET FLUX DENSITY 11,000 GAUSS
TOTAL FLUX - 58,000 MAXWELLS
SENSITIVITY 96 dB spc@1 m, 11.2 v RMS
THEIL-SMALL PARAMETERS
$S_D$=92 cm$^2$
$M_D$=9.8 gm
$X_D$=6 mm peak to peak
$f_s$=37 HZ
Rms=1Ω
Cms=1.8×10$^{-3}$ M/N
VAS=23.6 liters
QM=2.44
QE=0.38
QT=0.33
IMPEDANCE 8 Ω
RANGE 55 $H_Z$ to 3,500 $H_Z$
NET WEIGHT 1.13 kg.

MICROPHONE

FREQ. RESPONSE 20–13,000 HZ
IMPEDANCE 600
SENSITIVITY −71 dB±5 dB
(REF OJB=1 v/μbar, 1 KHZ)
POWER 1.5 VDC to 20 VDC−

Figure 11:
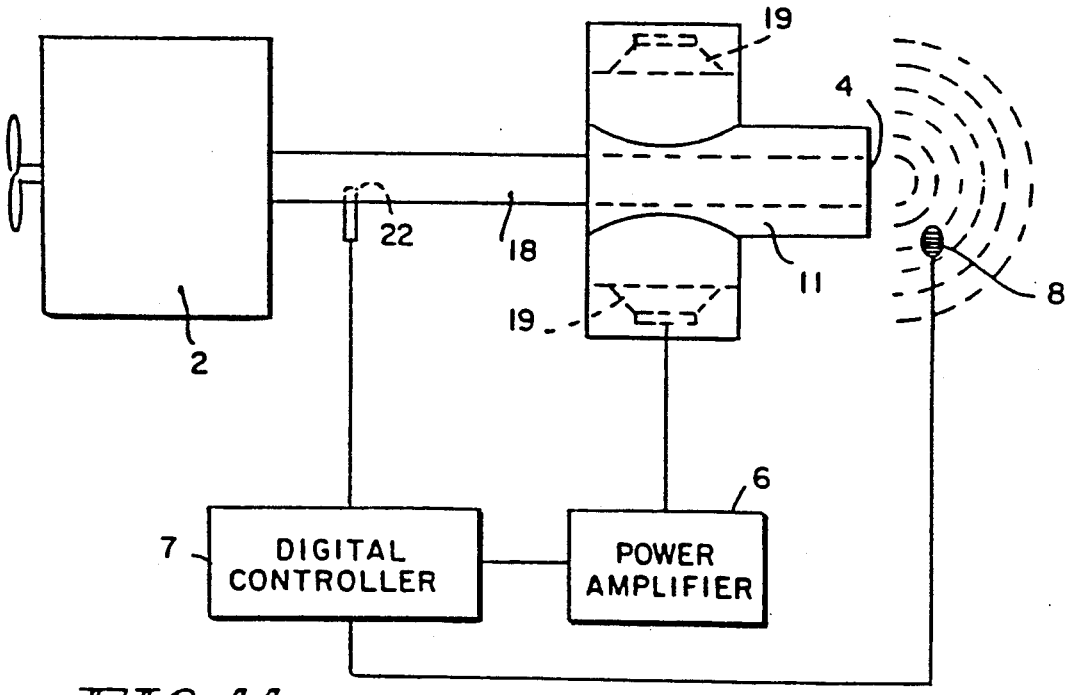
FIG. 11 is a schematic depiction of a complete active digital muffler system constructed according to another preferred embodiment of the present invention.

A second control system for the active digital muffler system is schematically depicted in FIG. 11. Since the FIG. 11 system only differs from the FIG. 10 system in the utilization of an upstream sensor microphone 22, in lieu of the tachometer synchronizing sensor 9, the remaining structure is depicted by similar reference numerals as in FIG. 10. Similarly to the FIG. 10 embodiment, either of a frequency domain alogorithm controller or a time domain alogorithm controller can be utilized. The difference between the FIG. 10 and 11 embodiment resides in that the input from microphone 22 is utilized instead of the input from a tachometer sensor 9 as in FIG. 10.

It is further noted that a controller corresponding to the NCT 2000 controller marketed by Noise Cancellation Technologies Inc., can be used to serve as controller 7.

Figure 12A:
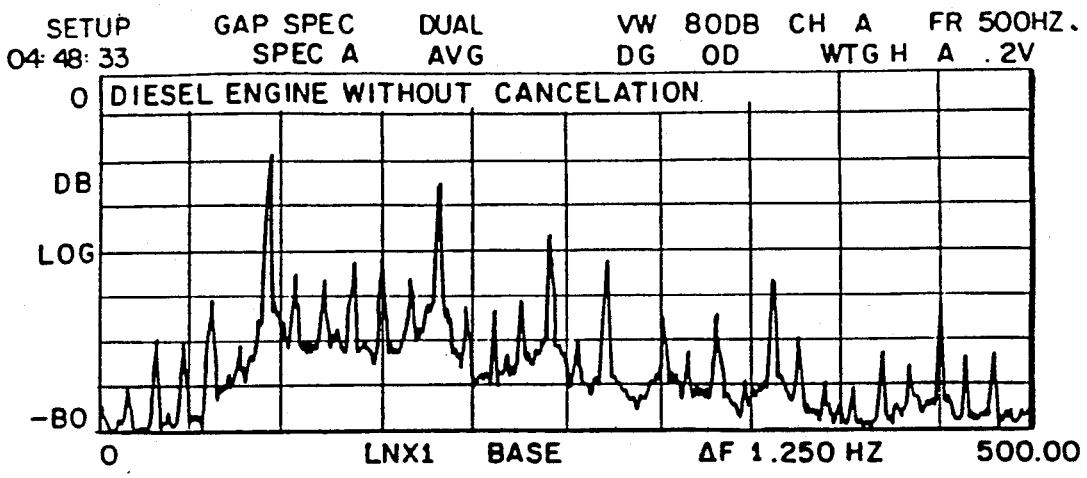
FIGS. 12A and 12B illustrate graphs for comparing test results on a vehicle with a diesel engine, showing the sound spectrum at the exhaust with and without noise attenuation using the system of the present invention.
Figure 12B:
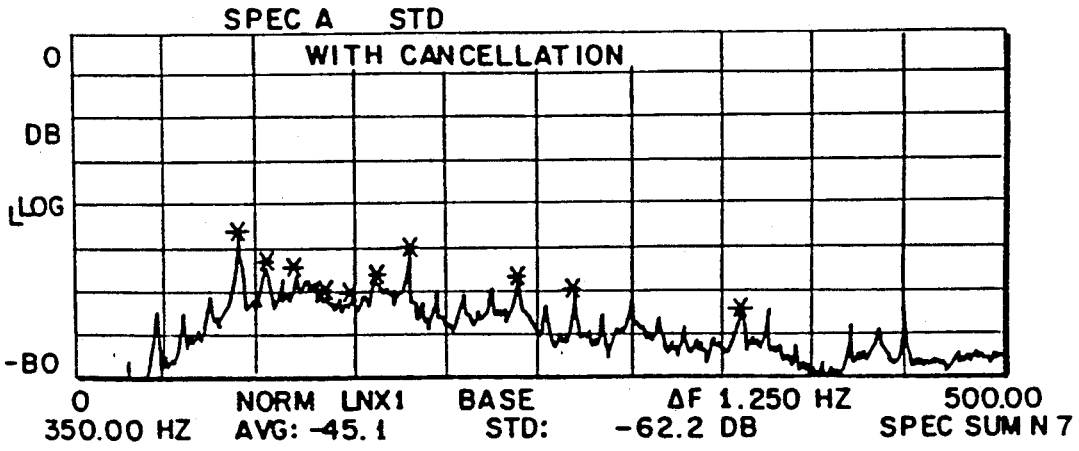

FIGS. 12A and 12B are graphical comparisons showing a dramatic reduction in noise levels utilizing the active digital muffler system on a diesel engine, as compared with operating the same diesel engine without cancellation. In FIG. 12A the graph shows the noise levels without cancellations and the graph of FIG. 12B shows the noise levels with cancellation. The following is a Table of the experimental results shown in the graphs of FIGS. 12A and 12B.

| MARK | LIST X | Y(U) | Y(L) |
|---|---|---|---|
| 0 | 90.000 | −18.0 | −44.5 |
| 1 | 104.99 | −45.3 | −51.8 |
| 2 | 120.00 | −45.9 | −53.4 |
| 3 | 135.00 | −41.8 | −59.7 |
| 4 | 150.00 | −38.3 | −60.3 |
| 5 | 165.00 | −45.9 | −56.0 |
| 6 | 180.00 | −24.8 | −49.4 |
| 7 | 240.00 | −36.1 | −58.2 |
| 8 | 270.00 | −40.8 | −58.2 |
| 9 | 360.00 | −46.1 | −52.2 |

From the Table and the graphs, substantial noise level reductions are recognizable, e.g. 26 decibels at mark 0 at 90 HZ frequency with the engine exhaust noise silenced by the sound attenuation system by the present invention. Accordingly, the passive muffler can be deleted from the vehicle exhaust pipe system. Deletion of the Passive muffler (so-called "straight pipe" operations) results in remarkable increases in engine efficiency and power, as is known to those skilled in the art of automotive internal combustion engines.

Although the present invention has been described and illustrated in detail, it is to be clearly understood that the same is by way of illustration and example only, and is not to be taken by way of limitation. The spirit and scope of the present invention are to be limited only by the terms of the appended claims.

We claim:

1. An active noise suppression system for exhaust of a combustion engine comprising:

an exhaust transfer pipe, coupled to the combustion engine and having first and second ends, for transferring exhaust gas in a first direction from the combustion engine to ambient atmosphere, said first end receiving the exhaust gas from the combustion engine and said second end emitting the exhaust gas to the ambient atmosphere;

an anti-noise chamber, annularly surrounding an outer periphery of said exhaust transfer pipe and having an outlet open to the ambient atmosphere adjacent said second end of said exhaust transfer pipe, for projecting anti-noise sound waves through said outlet to the ambient atmosphere;

an anti-noise speaker, mounted to said anti-noise chamber for communication therewith, for generating and projecting said anti-noise sound waves into said anti-noise chamber to cancel noise generated by the combustion engine exhaust;

separation means for isolating said anti-noise chamber from exhaust gas.

2. An active noise suppression system according to claim 1 further comprising another anti-noise speaker, said anti-noise speakers being disposed on said anti-noise chamber at opposed axial positions with respect to said exhaust transfer pipe upstream of said second end of said exhaust transfer pipe.

3. An active noise suppression system according to claim 2, wherein said anti-noise chamber is acoustically tuned and has a large diameter section joined to a smaller diameter section, said anti-noise speakers being mounted to said large diameter section, said smaller diameter section extending along said exhaust transfer pipe to said second end.

4. An active noise suppression system according to claim 3, wherein a front end of said large diameter section is closed off by an annular plate connected to an outer position of said exhaust transfer pipe, an outlet end of said smaller diameter section serving as said outlet of said anti-noise chamber which is supported from said exhaust transfer pipe by radially extending support plates.

5. An active noise suppression system according to claim 1, wherein said anti-noise chamber is symmetrically configured with respect to a longitudinal axis through a center of said exhaust transfer pipe.

6. An active noise suppression system according to claim 5, wherein said exhaust transfer pipe and said anti-noise chamber are cylindrical and concentric with respect to said longitudinal axis.

7. An active noise suppression system according to claim 1, further comprising a cooling chamber, disposed annularly between said exhaust transfer pipe and said anti-noise chamber, for drawing cooling air from the ambient atmosphere into said exhaust transfer pipe to cool said exhaust gas within said exhaust transfer pipe, said separation means comprising an outer wall of said cooling chamber.

8. The active noise suppression system according to claim 7, wherein said cooling chamber draws cooling air inward from adjacent said second end of said exhaust transfer pipe to flow in a second direction opposite the flow of exhaust gas through said exhaust transfer pipe in said first direction.

9. An active noise suppression system according to claim 8, wherein said exhaust transfer pipe has air flow openings for passing said cooling air from said cooling chamber into said exhaust transfer pipe, said air flow openings being symmetrically disposed about a circumference of said exhaust transfer pipe.

10. An active noise suppression system according to claim 9, wherein said air flow openings comprised of at least four separate radial openings.

11. An active noise suppression system according to claim 9, wherein said air flow openings are comprised of eight separate radial openings.

12. The active noise suppression system according to claim 1, wherein said combustion engine is an internal combustion engine.

13. An active noise suppression system according to claim 12, wherein the combustion engine being a driving engine for a motor boat.

14. An active noise suppression system according to claim 12, wherein the combustion engine is a driving engine for a motorized road passenger vehicle.

15. An active noise suppression system according to claim 1, wherein the combustion engine has an exhaust pipe for delivering the exhaust gas to said first end of said exhaust transfer pipe, said first end of said exhaust transfer pipe being insertable into said exhaust pipe and permanently affixable thereto by clamping seal means.

16. An active noise suppression system according to claim 15, wherein said exhaust transfer pipe, said anti-noise chamber and said anti-noise speakers are integrally constructed within a unitary sheet metal housing.

17. The active noise suppression system of claim 1, wherein said separation means comprises an outer wall of said exhaust transfer pipe.

18. An active noise suppression system for exhaust of a combustion engine comprising:

an exhaust transfer pipe, coupled to the combustion engine and having first and second ends, for transferring exhaust gas in a first direction from the combustion engine to ambient atmosphere, said first end receiving exhaust gas from the combustion engine and said second end emitting the exhaust gas to the ambient atmosphere;

passive noise reduction means surrounding an outer periphery of said exhaust transfer pipe, for reducing noise generated by the combustion engine and exhaust gas turbulence by cooling the exhaust gas within said exhaust transfer pipe;

active noise reduction means for attenuating noise generating by the combustion engine and exhaust, said active noise reduction means comprising an anti-noise chamber surrounding an outer periphery of said passive noise reduction means, having an outlet port open to the ambient atmosphere adjacent said second end of said exhaust transfer pipe, for projecting anti-noise sound waves through said outlet port to the ambient atmosphere, an anti-noise speaker, mounted to said anti-noise chamber, for generating and projecting said anti-noise sound waves into said anti-noise chamber to further reduce noise generated by the combustion engine and exhaust; and separation means for isolating said anti-noise chamber from exhaust gas.

19. The active noise suppression system of claim 18, further comprising plural anti-noise speakers mounted to said anti-noise chamber.

20. The active noise suppression system of claim 18, wherein said passive noise reduction means comprises a cooling chamber having an outlet end open to the ambient atmosphere for drawing inward cooling air from the ambient atmosphere.

21. The active noise suppression system of claim 20, wherein exhaust transfer pipe has air flow openings arranged around an outer periphery thereof near said first end for drawing said cooling air from said cooling chamber into said exhaust transfer pipe to reduce turbulence of the exhaust gas to reduce noise.

22. The active noise suppression system of claim 18, wherein said exhaust transfer pipe is provided with air flow openings communications with said passive noise reduction means.

23. The active noise suppression system of claim 21, wherein said exhaust transfer pipe, cooling chamber, anti-noise chamber and anti-noise speakers are integrally constructed within a unitary sheet metal housing.

24. The active noise suppression system of claim 23, wherein said combustion engine has an exhaust pipe for delivering the exhaust gas to said first end of said exhaust transfer pipe, said first end being insertable into said exhaust pipe and affixable thereto permanently by sealing clamp means.

25. The active noise suppression system of claim 18, wherein said anti-noise chamber is acoustically tuned and comprises a first section of large diameter coupled to a second section of smaller diameter, said anti-noise speakers comprising two speakers mounted to an outer periphery of said first section 180° apart from each other.

26. The active noise suppression system of claim 18, wherein said exhaust transfer pipe, passive noise reduction means, active noise reduction means and anti-noise speakers are integrally constructed within a unitary sheet metal housing.

27. The active noise suppression system of claim 18, wherein said separation means comprises an outer wall of said passive noise reduction means.

28. An integrally housed anti-noise suppression system comprising:

an exhaust transfer pipe having first and second ends, for transferring exhaust gas in a first direction from a combustion engine to ambient atmosphere, said first end receiving exhaust gas from an exhaust pipe of the combustion engine and said second end emitting the exhaust gas to the ambient atmosphere;

an anti-noise chamber, surrounding an outer periphery of said exhaust transfer pipe and having an outlet port open to the ambient atmosphere adjacent said second end of said exhaust transfer pipe, for projecting anti-noise sound waves through said outlet to the ambient atmosphere;

an anti-noise speaker, mounted to an outer periphery of said anti-noise chamber, for generating and propagating said anti-noise sound waves into said anti-noise chamber to cancel noise generated by said combustion engine and said exhaust pipe; and separation means for isolating said anti-noise chamber from exhaust gas, said exhaust transfer pipe, anti-noise chamber and anti-noise speakers are constructed and integrally housed within a sheet metal structure.

29. The integrally housed anti-noise suppression system of claim 28, wherein, said first end of said exhaust transfer pipe is insertable and permanently affixable by clamp sealing means to said exhaust pipe.

30. The integrally housed anti-noise suppression system of claim 29, further comprising:

a cooling chamber, disposed annularly between said exhaust transfer pipe and said anti-noise chamber and having an outlet end open to the ambient atmosphere, for drawing cooling air inward from the ambient atmosphere, said separation means comprising an outer wall of said cooling chamber.

31. The integrally housed anti-noise suppression system of claim 30, wherein said cooling air is drawn into said cooling chamber in a second direction opposite to said first direction of exhaust gas flow within said exhaust transfer pipe.

32. The integrally housed anti-noise suppression system of claim 28, further comprising an additional anti-noise speaker mounted to an outer periphery of said anti-noise chamber, wherein said anti-noise chamber is acoustically tuned and has a first section of large diameter coupled to a second section of smaller diameter, said anti-noise speakers operatively coupled to an outer periphery of said first section 180° apart from each other.

33. The integrally housed anti-noise suppression system of claim 31, wherein said separation means comprises an outer wall of said exhaust transfer pipe.

* * * * *